US012054817B1

(12) United States Patent
Lambert et al.

(10) Patent No.: US 12,054,817 B1
(45) Date of Patent: Aug. 6, 2024

(54) HIGH-STRENGTH AND HIGH-TOUGHNESS AUSTENITIC STEEL

(71) Applicant: United States of America as Represented by the Secretary of the Navy, Arlington, VA (US)

(72) Inventors: Paul Lambert, Columbia, MD (US); Matthew Draper, Annandale, VA (US); Matthew Sinfield, Glenwood, MD (US); Daniel Bechetti, Columbia, MD (US)

(73) Assignee: United States of America, represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/523,863

(22) Filed: Nov. 10, 2021

Related U.S. Application Data

(60) Provisional application No. 63/111,965, filed on Nov. 10, 2020.

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/001* (2013.01); *C22C 38/002* (2013.01);
(Continued)

(58) Field of Classification Search
CPC ..... C22C 38/58; C22C 38/02; C22C 38/06; C22C 38/38; C22C 38/42; C22C 38/44;
(Continued)

(56) References Cited

U.S. PATENT DOCUMENTS 8,308,874 B1 11/2012 Clark et al.
9,347,121 B2 5/2016 Forbes Jones
(Continued)

FOREIGN PATENT DOCUMENTS

DE 102018201855 A1 * 8/2019
JP H 08246049 A * 9/1996
(Continued)

OTHER PUBLICATIONS

Fayek et al., DE102018201855 A1 Google machine translation printed on Aug. 22, 2022, Aug. 8, 2019, entire translation ( Year: 2019).*

(Continued)

*Primary Examiner* — Katherine A Christy
(74) *Attorney, Agent, or Firm* — Dave Ghatt; Jesus J. Hernandez

(57) ABSTRACT

The invention is a high strength austenitic steel composition having increased strength and toughness characteristics, applicable for use in a seawater environment. The high strength austenitic steel may include nanometer-scale carbides, carbonitrides of vanadium, and carbides and carbonitrides having molybdenum, titanium, and niobium. The austenitic steel includes, 0.15-0.5 wt. % of carbon, 0-0.8 wt. % of silicon 6-14 wt. % of manganese, 9-13.5 wt. % of nickel, 0-3 wt. % of copper; 0.8-2.2 wt. % of vanadium, 0-4 wt. % of molybdenum, 0-4 wt. % of chromium; 0-0.9 wt. % of aluminum, 0-0.1 wt. % of calcium, 0-0.3 wt. % of titanium, 0-0.6 wt. % of niobium, 0-0.2 wt. % of tungsten, 0-0.2 wt. % of nitrogen, 0-0.1 wt. % of cerium, 0-0.1 wt. % of lanthanum, 0-0.05 wt. % of sulfur, and 0-0.05 wt. % of phosphorus.

2 Claims, 6 Drawing Sheets

(51) Int. Cl.

| | |
|---|---|
| ***C22C 38/02*** | (2006.01) |
| ***C22C 38/06*** | (2006.01) |
| ***C22C 38/38*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |

(52) U.S. Cl.
CPC ..... *C22C 38/005* (2013.01); *C22C 38/02* (2013.01); *C22C 38/06* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/001* (2013.01)

(58) Field of Classification Search
CPC ..... C22C 38/46; C22C 38/48; C22C 38/50; C22C 38/52; C22C 38/001; C21D 2211/001
USPC ..... 428/544
See application file for complete search history.

(56) References Cited

U.S. PATENT DOCUMENTS

| | | | | |
|---|---|---|---|---|
| 10,329,650 | B2 | 6/2019 | Cha | |
| 10,655,196 | B2 | 5/2020 | Lee et al. | |
| 10,889,870 | B2 | 1/2021 | Obayashi et al. | |
| 2005/0194073 | A1* | 9/2005 | Hamano | C22C 38/001 148/326 |
| 2010/0135745 | A1 | 6/2010 | Resiak | |
| 2010/0282374 | A1 | 11/2010 | Mataigne et al. | |
| 2016/0130711 | A1* | 5/2016 | Fujita | C22C 38/18 148/504 |
| 2017/0349983 | A1* | 12/2017 | Jin | C21D 8/0226 |
| 2018/0258515 | A1* | 9/2018 | Suh | C21D 6/005 |
| 2019/0389178 | A1 | 12/2019 | Becker et al. | |

FOREIGN PATENT DOCUMENTS

| | | | |
|---|---|---|---|
| JP | 4529872 | B2 * | 8/2010 |
| RU | 2447186 | C2 * | 4/2012 |

OTHER PUBLICATIONS

Aihara, JPH 08246049 A Google machine translation printed on Aug. 22, 2022, Sep. 24, 1996, entire translation (Year: 1996).*
Okaguchi, JP4529872B2 Google Patents machine translation printed on Dec. 15, 2022, Aug. 25, 2010, entire translation ( Year: 2010).*
Bannykh et al., RU 2447186C2 Google Patents machine translation printed on Jun. 22, 2023 and written translation of Table 2 provided on Jun. 22, 2023 and Table 3 provided on Jun. 26, 2023, Apr. 10, 2012, entire translation (Year: 2012).*

* cited by examiner

HIGH-STRENGTH AND HIGH-TOUGHNESS AUSTENITIC STEEL

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application claims the benefit of U.S. Provisional Application No. 63,111,965 filed Nov. 10, 2020, titled "High-Strength and High-Toughness Austenitic Steel," incorporated herein by reference.

TECHNICAL FIELD

The following description relates generally to a high-strength, high-toughness austenitic steel for structural applications in a seawater environment, and in particular a steel that may include nanometer-scale carbides, carbonitrides of vanadium, and carbides and carbonitrides having molybdenum, titanium, and niobium.

BACKGROUND

There is a need for nonmagnetic austenitic structural steels with high yield strengths (exceeding 80 ksi) that also exhibit high fracture toughness in weldable cast, forged, and rolled structural members. Often, high strength is achieved in high-nitrogen austenitic stainless steels. However, these steels are rich in expensive alloying elements, which present difficulties with welding, and generally require some kind of thermomechanical processing to exhibit a yield strength exceeding 80 ksi. Additionally, achieving high toughness levels in both base materials and weld consumables with increasing yield strength has been shown to be highly challenging for future classes of structural steels.

An alternative approach is to use steels strengthened by precipitates such as vanadium carbide or vanadium carbonitride. However, according to known thermodynamic and kinetic calculations performed using known databases, under some circumstances these precipitates may partially or completely dissolve in the Heat Affected Zone (HAZ) during welding. This has the undesired result of rapid grain growth and loss of strength and/or toughness in the welded part. It is desired to have a precipitation-strengthened austenitic steel that, in addition to vanadium carbide or vanadium carbonitride, also incorporates titanium carbides and carbonitrides as well as niobium carbides and carbonitrides, which dissolve at higher temperatures than vanadium carbide or vanadium carbonitride, and are intended to reduce grain growth in the welded HAZ.

SUMMARY

In one aspect, the invention is an austenitic steel composition having increased strength and toughness characteristics. According to the invention, the austenitic steel includes, 0.15-0.5 wt. % of carbon, 0-0.8 wt. % of silicon, 6-14 wt. % of manganese, 9-13.5 wt. % of nickel, 0-3 wt. % of copper; 0.8-2.2 wt. % of vanadium, 0-4 wt. % of molybdenum, 0-4 wt. % of chromium; 0-0.9 wt. % of aluminum, 0-0.1 wt. % of calcium, of titanium, 0-0.6 wt. % of niobium, 0-0.2 wt. % of tungsten, 0-0.2 wt. % of nitrogen, 0-0.1 wt. % of cerium; 0-0.1 wt. % of lanthanum, 0-0.05 wt. % of sulfur, and 0-0.05 wt. % of phosphorus.

BRIEF DESCRIPTION OF THE DRAWINGS

Other features will be apparent from the description, the drawings, and the claims.

DETAILED DESCRIPTION

Figure 1:
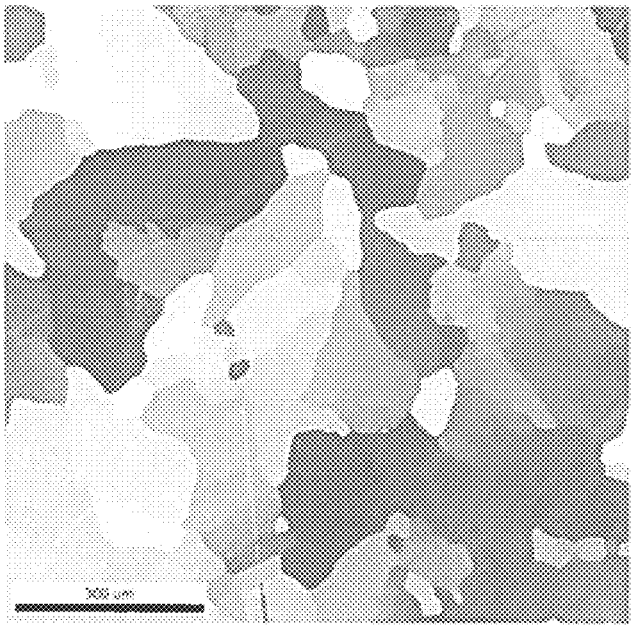
FIG. 1 is an exemplary micrographic illustration of the as-cast material of the Example 1 produced using electron backscatter diffraction (EBSD).

The present invention is a steel, having a face-centered cubic austenitic matrix structure. As outlined below, the austenitic steel of the invention is non-stainless, i.e., containing less than 12 wt. % Cr and strengthened by (V, Mo) carbides and carbonitrides to a yield strength exceeding 80 ksi, while also containing (Ti, Nb) carbides and carbonitrides. According to the invention, this structure is stabilized by additions of C, Ni, and Mn, and optionally with N, Cu, and Cr.

As outlined below, the austenitic steel of the invention contains vanadium carbides, and also carbides of titanium and niobium. In embodiments having molybdenum, the vanadium carbides will also contain molybdenum. As outlined below, embodiments may or may not have nitrogen. Embodiments that have nitrogen will have carbonitrides that are produced by the nitrogen and carbon, which is present in all embodiments.

The steel of the invention also incorporates elements for solid solution strengthening, deoxidation, and grain refinement. The material is cast using standard practices, subjected to a solution heat treatment at a temperature of 1050-1250° C. and rapidly cooled to room temperature (e.g. by quenching in water or by forced air cooling), and then age-hardened at a temperature of 625-700° C. for up to 20 hours to produce strengthening VC precipitates. Alternatively, a two-step age-hardening process may be employed instead of the single-step age-hardening treatment, e.g. treatment at a temperature of 550-625° C. for up to 20 hours followed by a treatment at 630-700° C. for up to 20 hours.

According to the invention, the austenitic steel composition has increased strength and toughness characteristics. According to the invention, the austenitic steel includes, 0.15-0.5 wt. % of carbon, 0-0.8 wt. % of silicon, 6-14 wt. % of manganese, 9-13.5 wt. % of nickel, 0-3 wt. % of copper; 0.8-2.2 wt. % of vanadium, 0-4 wt. % of molybdenum, 0-4 wt. % of chromium; 0-0.9 wt. % of aluminum, 0-0.1 wt. % of calcium, wt. % of titanium, 0-0.6 wt. % of niobium, 0-0.2 wt. % of tungsten, 0-0.2 wt. % of nitrogen, 0-0.1 wt. % of cerium; 0-0.1 wt. % of lanthanum, 0-0.05 wt. % of sulfur, and 0-wt. % of phosphorus. According to the invention, the austenitic steel may also include 0-1 wt. % of cobalt.

As stated above, according to this embodiment, the alloy composition includes 0.15 to 0.5 wt. % carbon. The carbon in this composition contributes to stabilizing the austenitic structure of the alloy, while also providing solid solution strengthening. The 0.15-0.5 wt. % of carbon also promotes the formation of carbides and carbonitrides. These carbides and carbonitrides increase the yield strength of the steel and may also reduce the austenite grain size of the alloy by pinning grain boundaries.

Also, according to this embodiment the alloy composition includes up to about 0.8 wt. % silicon. This composition of silicon serves to deoxidize the austenitic steel composition during processing. The 0-0.8 wt. % of silicon also improves melt fluidity, and influences precipitation of carbides and carbonitrides. The alloy composition also includes 6 to 14 wt. % manganese. This composition of manganese contributes to stabilizing the austenitic structure of the alloy, and improves nitrogen solubility in the molten material during casting.

As stated above, the austenitic steel composition includes 9 to 13.5 wt. % nickel. This composition of nickel contributes to stabilizing the austenitic structure of the alloy. The 9-13.5 wt. % of nickel also increases toughness and ductility, and accelerates the formation of carbides and carbonitrides. The austenitic steel composition also includes 0 to 3 wt. % copper. This composition of copper in the austenitic steel composition contributes to stabilizing the austenitic structure of the alloy, and improves resistance to general corrosion. The 0-3 wt. % copper also accelerates the formation of carbides and carbonitrides.

According to the invention, the austenitic steel composition includes 0.8 to 2.2 wt. % vanadium. This composition of vanadium increases the yield strength of the austenitic steel alloy by forming carbides and carbonitrides during an aging heat treatment. The 0.8-2.2 wt. % of vanadium also provides solid solution strengthening. The austenitic steel composition also includes 0 to about 4 wt. % molybdenum. This composition of molybdenum improves the properties of the vanadium carbides and carbonitrides formed in the alloy, contributing to high yield strength. The 0-4 wt. % of molybdenum also provides solid solution strengthening.

According to the invention, the austenitic steel composition includes 0 to 4 wt. % chromium. This composition of chromium provides solid solution strengthening to the austenitic steel alloy, improves nitrogen solubility, and lowers the temperature at which martensite will form. The austenitic steel composition also includes 0 to 0.9 wt. % aluminum. This composition of aluminum provides solid solution strengthening. The 0-0.9 wt. % of aluminum also contributes to grain refinement and deoxidation of the austenitic steel alloy during processing.

As stated above, the austenitic steel composition includes 0 to 0.1 wt. % calcium. This composition of calcium contributes to grain refinement and deoxidation of the alloy during processing. The austenitic steel composition also includes 0 to 0.3 wt. % titanium. This composition of titanium forms carbides and carbonitrides and reduces the austenite grain size by pinning grain boundaries.

According to the invention, the austenitic steel composition includes 0 to 0.6 wt. % niobium. This composition of niobium forms carbides and carbonitrides and reduces the austenite grain size by pinning grain boundaries. The austenitic steel composition also includes 0 to 0.2 wt. % tungsten. This composition of tungsten forms carbides and carbonitrides and reduces the austenite grain size by pinning grain boundaries.

The austenitic steel composition of the invention includes 0 to 0.2 wt. % nitrogen. This composition of nitrogen provides solid solution strengthening and contributes to stabilizing the austenitic structure of the alloy. As stated above, embodiments that have nitrogen, contain carbonitrides that are produced by the nitrogen content. Here, the 0-0.2 wt. % of nitrogen contributes to the formation of strengthening carbonitrides.

The austenitic steel composition also includes 0 to 0.1 wt. % cerium. The compounds formed by cerium act as nucleation sites during solidification, thereby refining grain size. The austenitic steel composition of the invention also includes 0 to about 0.1 wt. % lanthanum. The compounds formed by lanthanum act as nucleation sites during solidification, refining grain size.

According to the invention, in the austenitic steel composition, the sum of the total contents of titanium and niobium, [Ti+Nb] should exceed 0.02 wt % for adequate grain boundary pinning at elevated temperatures. For most effective precipitation strengthening, the product of the concentrations of elements Carbon and Nitrogen combined, and vanadium, [C+N][V] (expressed in weight percent) should be at least 0.33. It should be understood that the concentration of impurity elements sulfur and phosphorus in the austenitic steel composition should each be below 0.05 wt. %.

The austenitic steel composition of the invention may be prepared in a forged or rolled condition, in which the cast material undergoes an initial homogenization heat treatment at 1050-1250° C., followed by a hot rolling or forging in the temperature range of 800-1250° C. If the austenitic steel composition of the invention is for use in a cast state, both the initial homogenization heat treatment and the hot rolling or forging operations may be neglected.

Following any forging or hot-rolling processes, the austenitic steel composition material may undergo a solution heat treatment at 1050-1250° C., followed by a water quench or air cool. Next, the austenitic steel material may undergo either a one-step age-hardening treatment, such as heating at 625-700° C. for 1-20 hours, followed by an air cool or water quench. A two-step age-hardening treatment may also be employed, such as heat treatment at 550-625° C. for 1-20 hours, followed by heat treatment at 630-700° C. for 1-20 hours, with both treatments concluded either by an air cool or water quench.

Example 1 of an austenitic steel composition, according to the invention is shown in Table 1. As shown, Example 1 includes, 0.383 wt. % of carbon, 0.0721 wt. % of silicon, 6.92 wt. % of manganese, 13.0 wt. % of nickel, 1.91 wt. % of copper; 0.881 wt. % of vanadium, 0.94 wt. % of molybdenum, 0.104 wt. % of chromium; 0.0118 wt. % of aluminum, less than 0.005 wt. % of titanium, 0.0231 wt. % of niobium, 0.0124 wt. % of tungsten, 0.0097 wt. % of sulfur, less than 0.005 wt. % of phosphorus, and less than wt. % of cobalt.

TABLE 1

| | C wt. % | Si wt. % | Mn wt. % | Ni wt. % | Cu wt. % | V wt. % | Mo wt. % | Cr wt. % | Al wt. % | Ti wt. % | Nb wt. % | W wt. % | S wt. % | P wt. % | Co wt. % | Ca wt. % | N wt. % | Ce wt. % | La wt. % |
|---|---|---|---|---|---|---|---|---|---|---|---|---|---|---|---|---|---|---|---|
| Eg 1 | 0.383 | 0.0721 | 6.92 | 13 | 1.91 | 0.881 | 0.94 | 0.104 | .0118 | <.005 | .0231 | .0124 | .0097 | <.005 | <.001 | | | | |
| Eg 2 | 0.32 | 0.80 | 6.24 | 11.4 | 1.51 | 1.16 | 0.60 | 1.98 | 0.017 | 0.022 | .008 | 0.033 | 0.005 | 0.009 | 0.020 | | | | |
| Eg 3 | 0.2-0.45 | 0.1-0.8 | 6-10 | 10-13.0 | 0.5-2.5 | 0.8-1.4 | 0.5-2 | 0-3 | 0-0.05 | 0-0.2 | 0-0.3 | 0-0.05 | 0-0.04 | 0-0.04 | 0-0.1 | 0-0.1 | 0-0.2 | 0-0.1 | 0-0.1 |
| Eg 4 | 0.2 0.4 | 0.2-0.6 | 6-9 | 10-13.0 | 1-2 | 0.9-1.3 | 0.6-1.5 | 0.3-2 | 0-0.05 | 0-0.08 | 0.02-0.2 | 0-0.05 | 0-0.03 | 0-0.03 | 0-0.1 | 0-0.1 | 0-0.15 | 0-0.1 | 0-0.1 |

As referenced above, for the most effective precipitation strengthening, the product of the concentrations of elements Carbon and Nitrogen combined, and vanadium, [C+N][V] (expressed in weight percent) should be at least 0.33. In Example 1, the value of [0.383+0][0.881] exceeds 0.33, and thus has desired precipitation strengthening attributes. Also, as stated above, the sum of the total contents of titanium and niobium, [Ti+Nb] should exceed 0.02 wt. % for adequate grain boundary pinning at elevated temperatures. For Example 1, this value is less than [0.0124+0.0231], which exceeds wt. %.

The austenitic steel of the Example 1 may be cast using standard practices, and may be prepared in a forged or rolled condition. FIG. 1 is an exemplary micrographic illustration of the as-cast material of the Example 1 produced using electron backscatter diffraction (EBSD). Pixels in the image were indexed as face-centered cubic iron by the EBSD collection software. The image confirms that Example 1 is primarily non-magnetic face-centered cubic austenite.

According to the invention, Example 1 may be heat-treated, for example, in a two-step process. The first step may be a solutionizing treatment, in which the material is held for 16 hours at 1200° C., then quenched in room-temperature water. The second step may be aging treatment. Accordingly, the material is held at temperatures ranging from 625-700° C. for times ranging from 1-15 hours, then quenched in room-temperature water.

Figure 2A:
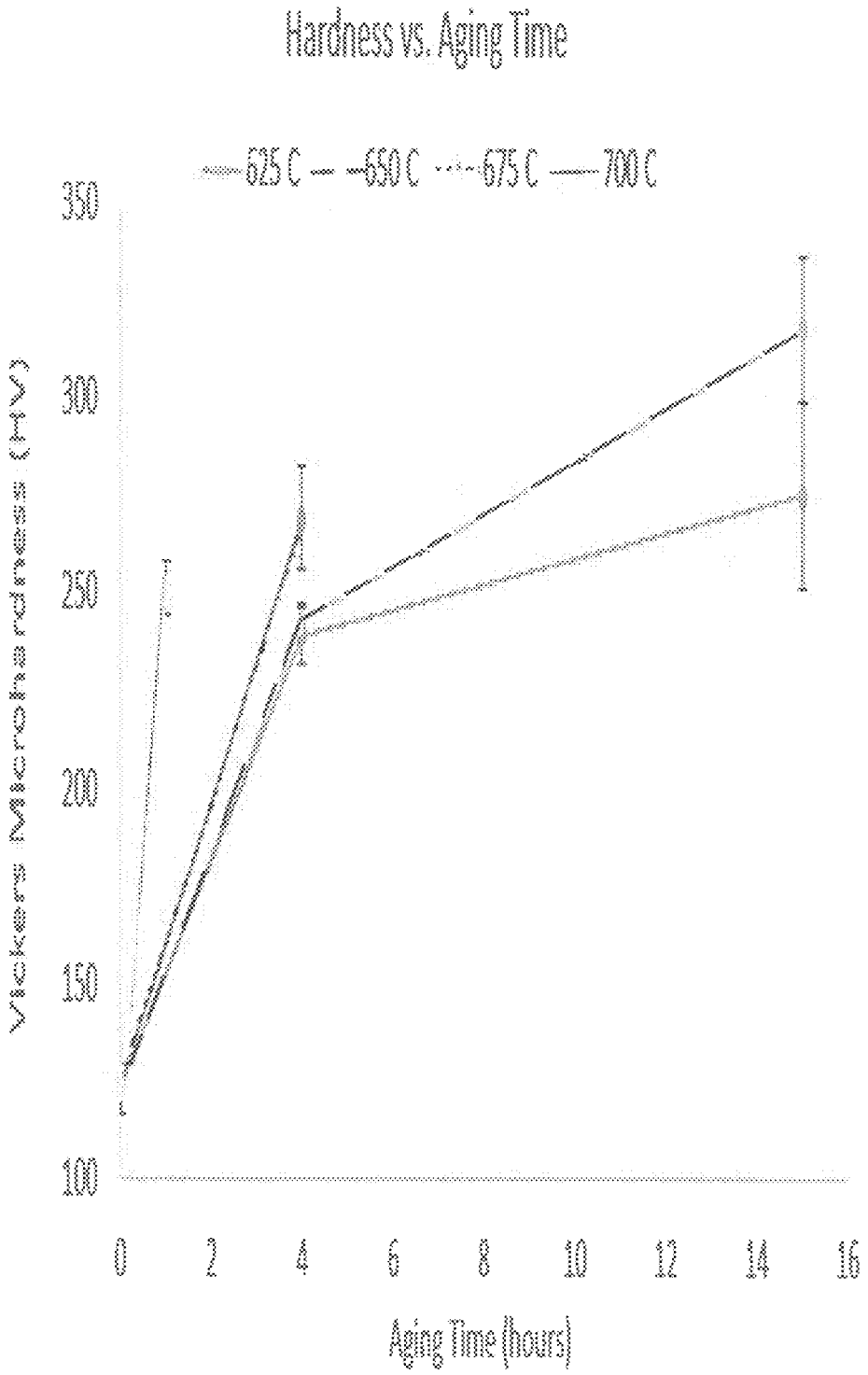
FIG. 2A is an exemplary graphical illustration of the Vickers Hardness vs Aging Time for Example 1, according to different heat treatment parameters.

FIG. 2A is an exemplary graphical illustration of the Vickers Hardness vs Aging Time for Example 1, according to different heat treatment parameters. As illustrated, FIG. 2A shows how the hardness increases over time, according to the heat treatment applied. FIG. 2A shows different results for treatment at 625° C., 650° C., 675° C., and 700° C. As shown, the sharpest increase in hardness over time is achieved for heat treatments at 700° C. FIG. 2A shows the smallest gradient increase in hardness achieved for temperature 625° C., although for up to about 4 hours, this increase in hardness for 625° C. is close to that of what is attained at 650° C.

Figure 2B:
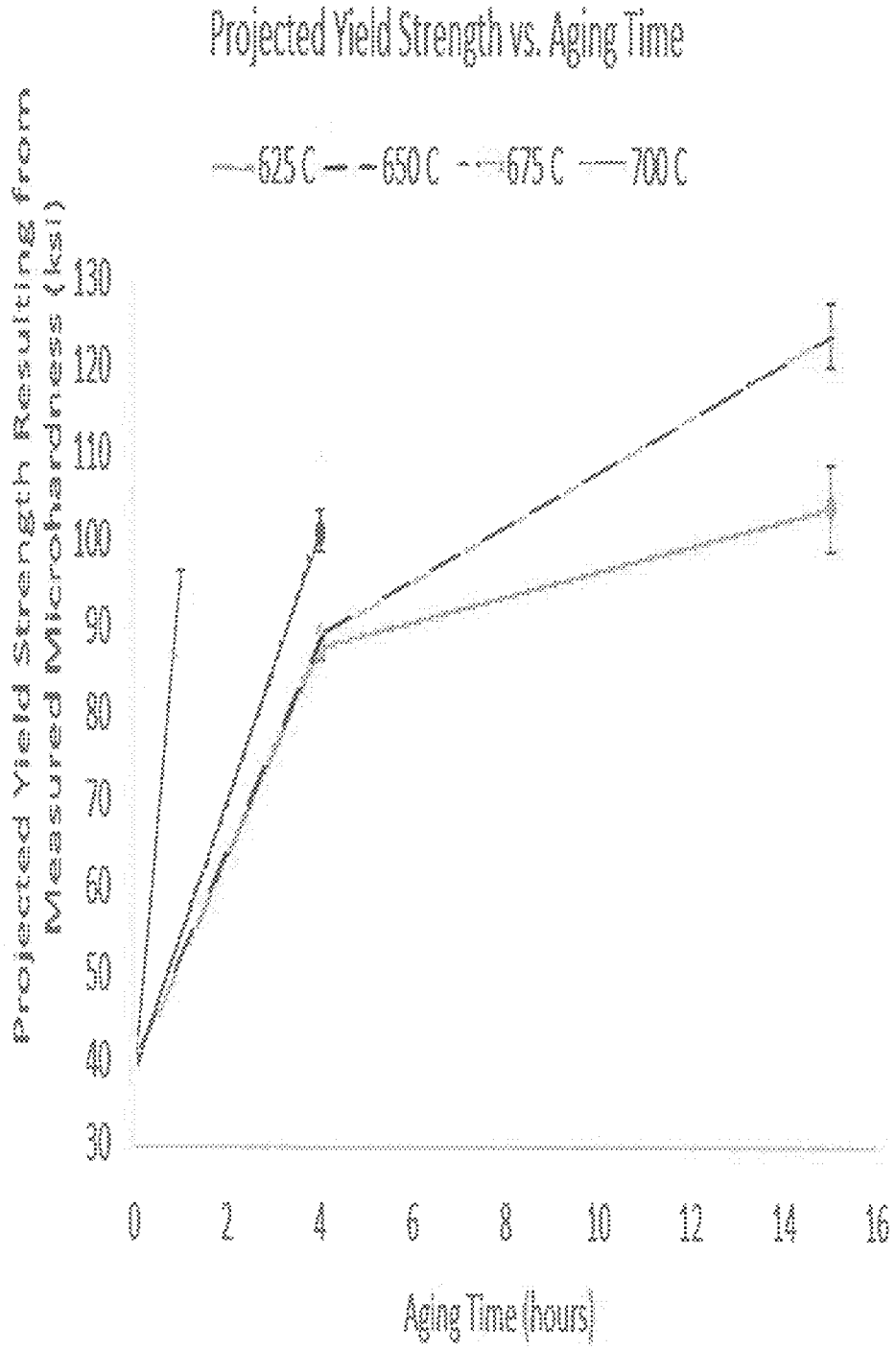
FIG. 2B is an exemplary graphical illustration of the estimated Yield Strength based on an empirical relation to Vickers Hardness vs Aging Time for Example 1, according to different heat treatment parameters.

FIG. 2B is an exemplary graphical illustration of the estimated Yield Strength based on an empirical relation to Vickers Hardness vs Aging Time for Example 1, according to different heat treatment parameters. The yield strength is estimated from an empirical equation used by Wengrenovich, Northwestern University, 2016. As outlined in the publication, "The optimization and design of a fully austenitic, gamma-prime strengthened TRIP steel for blast and fragment resistance." Other known methods may be used to determine the yield strength. As illustrated, FIG. 2B shows how the yield strength increases over time, according to the heat treatment applied. FIG. 2B shows different results for treatment at 625° C., 650° C., 675° C., and 700° C. As shown, the sharpest increase in yield strength over time is achieved for heat treatments at 700° C. FIG. 2B shows the least steep increase in yield strength achieved for temperature 625° C., although for up to about 4 hours, this increase in yield strength for 625° C. is close to that of what is attained at 650° C.

Figure 3:
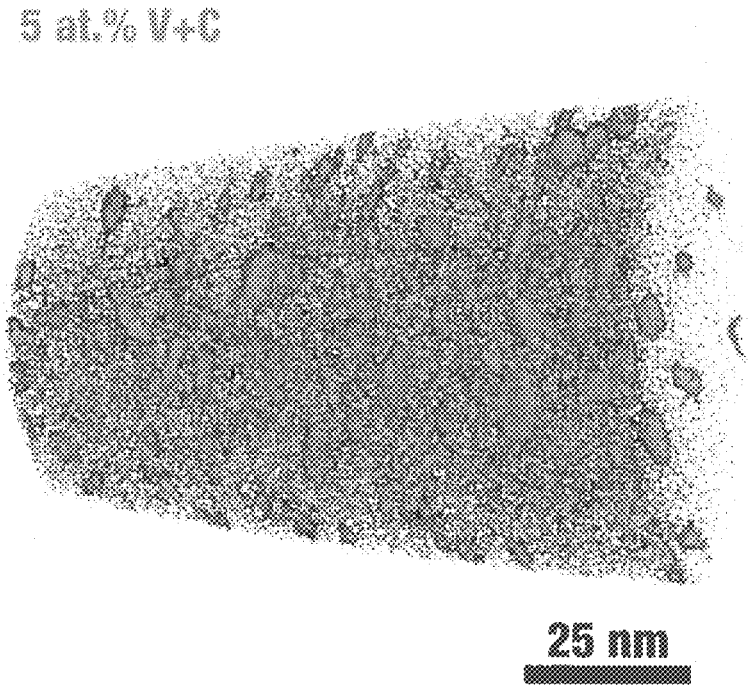
FIG. 3 is a 3-dimensional illustration of Example 1 produced using Atom Probe Tomography data, showing distribution of nanoscale particles, according to an embodiment of the invention.

FIG. 3 is a 3-dimensional illustration of Example 1 produced using Atom Probe Tomography data, showing distribution of nanoscale particles, according to an embodiment of the invention. The illustration of FIG. 3 is created via atom probe tomography (APT), using the Example 1 data collected on age-hardened sample 15 hours at 650° C. As shown, the APT reveals a dense distribution of nanometer-scale particles, illustrating the increase in hardness, as graphically illustrated in FIG. 2A. As outlined below, the FIG. 3 illustration also provides confirmation of (V, Mo) C precipitates. The solid spheroids shown in FIG. 3 indicate regions of the APT sample in which the concentrations of V and C (expressed in atomic percent) locally exceed 5%. This concentration greatly exceeds the concentration found in the austenitic matrix, and is indicative of the presence of a V- and C-rich carbide phase.

Figure 4:
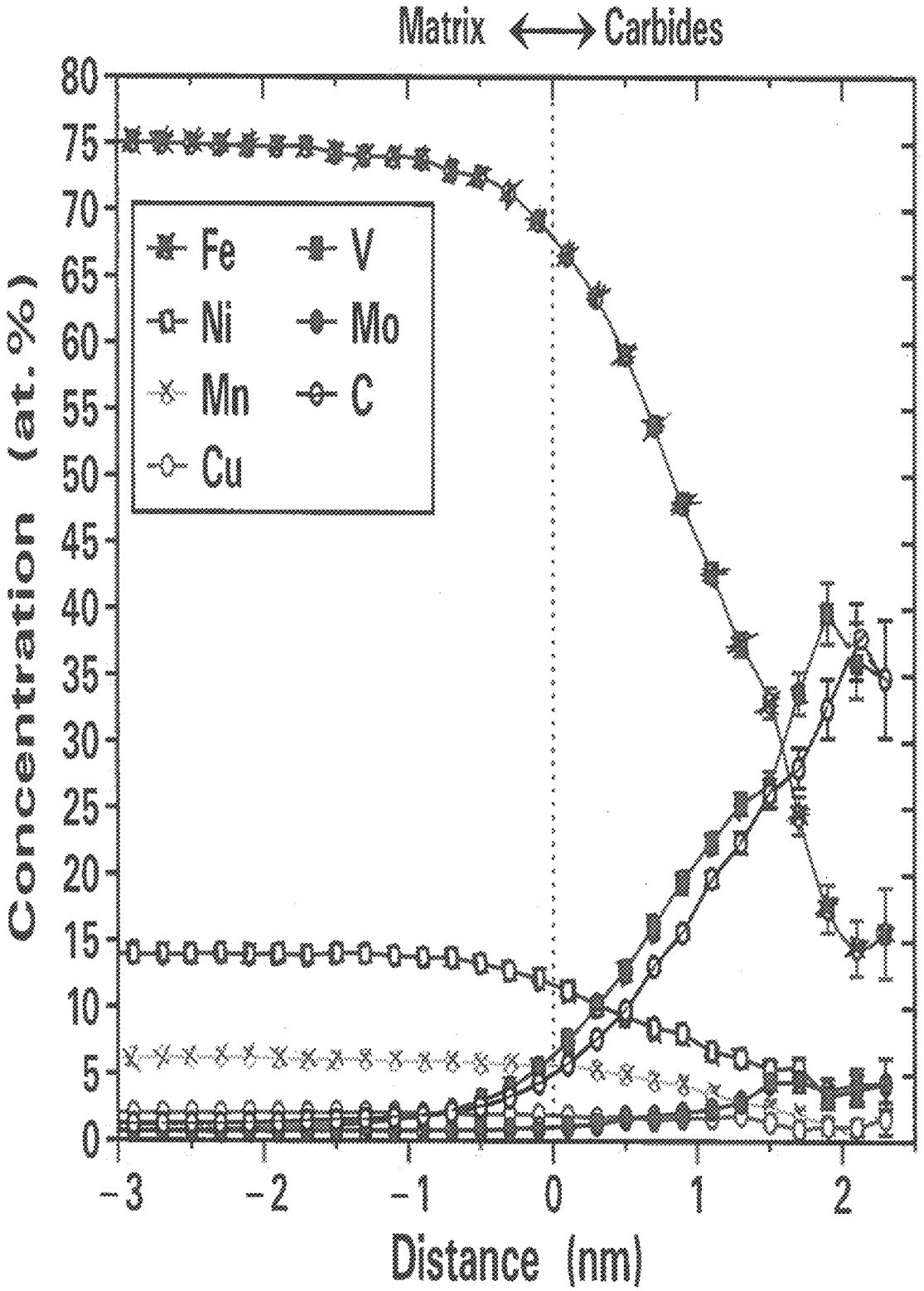
FIG. 4 is a graphical illustration of Example 1 produced using Atom Probe Tomography data, showing distribution of chemical elements across the boundary between a randomly-selected carbide precipitate and the surrounding austenite matrix, according to an embodiment of the invention.

FIG. 4 is a graphical illustration of Example 1 produced using Atom Probe Tomography data, showing distribution of chemical elements across the boundary between a randomly-selected carbide precipitate and the surrounding austenite matrix, according to an embodiment of the invention. The graphical illustration of FIG. 4 is created via atom probe tomography (APT), using the Example 1 data collected on age-hardened sample 15 hours at 650° C. The graph of FIG. 4 shows local concentration of chemical elements vs. distance from the boundary of a randomly-selected carbide, using the definition of a carbide boundary used in FIG. 3 (i.e. the first point at which the local concentrations of V and C exceed 5 atomic percent). The APT data collected on the age-hardened Example 1 (15 hours, 650° C.) reveals the particles consist mainly of Vanadium (V) and Carbon (C), with elevated levels of Mo also dissolved in the particles.

Regarding the V and C particles, they were delineated by 5 at. % V+C isoconcentration surface. The volume fraction was 0.71% and the number density was $3.74\times10^{23}$ $m^{-3}$, with the average radius being 1.5 nm, for 36(1)V-32(1)C-21(1)Fe-4.7(5)Ni-4.3(5)Mo-1.6(3)Mn-1.1(3)Cu (at. %).

Figure 5A:
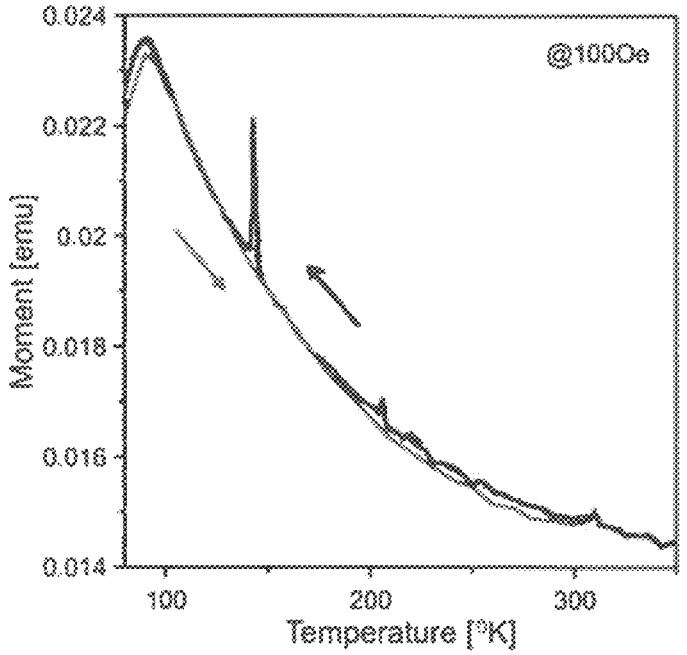
FIG. 5A is a graphical illustration of Example 1, showing the induced magnetic moment of a tested sample with respect to temperature at an applied field strength of 100 Oersteds, according to an embodiment of the invention.

FIG. 5A is a graphical illustration of Example 1, showing magnetic measurements with respect to temperature collected using a Vibrating Sample Magnetometer (VSM), according to the invention. FIG. 5A shows the induced magnetic moment in an applied field of 100 Oersteds for a specimen extracted from Example 1, for cooling the sample from 350 K down to 80 K (−193° C.) and heating back to room temperature. As shown, this process has no permanent effect on the material's low magnetic permeability, indicating a stable austenitic microstructure and low martensite-start temperature.

Figure 5B:
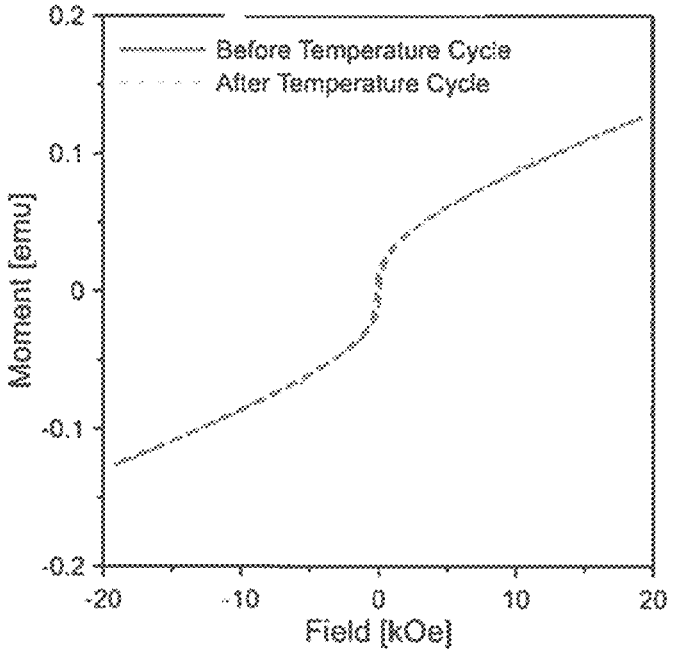
FIG. 5B is a graphical illustrations of Example 1, showing the induced magnetic moment with respect to applied field strength, according to an embodiment of the invention.

FIG. 5B is a graphical illustration of Example 1, showing magnetic measurements with respect to magnetic field applied during VSM measurements, according to the invention. FIG. 5B shows the induced magnetic moment for Example 1 with respect to applied field strength, both before and after the temperature cycling illustrated in FIG. 5A. As illustrated, the magnetic moment before and after the temperature cycles is the essentially the same. Again this shows that the process has no permanent effect on the material's low magnetic permeability, indicating a stable austenitic microstructure and low martensite-start temperature.

Example 2 of an austenitic steel composition, according to the invention is shown in Table 1. As shown, Example 2 includes, 0.32 wt. % of carbon, 0.80 wt. % of silicon, 6.24 wt. % of manganese, 11.4 wt. % of nickel, 1.51 wt. % copper; 1.16 wt. % of vanadium, 0.60 wt. % of molybdenum, 1.98 wt. % of chromium; 0.017 wt. % of aluminum, 0.022 wt. % of titanium, 0.008 wt. % of niobium, 0.033 wt. % of tungsten, 0.005 wt. % of sulfur, 0.009 wt. % of phosphorus, and 0.020 wt. % cobalt.

As referenced above, for the most effective precipitation strengthening, the product of the concentrations of elements Carbon and Nitrogen combined, and vanadium, [C+N][V] (expressed in weight percent) should be at least 0.33. In Example 1, the value of [0.32+0][1.16] exceeds 0.33, and thus has desired precipitation strengthening attributes. Also, as stated above, the sum of the total contents of titanium and niobium, [Ti+Nb] should exceed 0.02 wt. % for adequate grain boundary pinning at elevated temperatures. For Example 1, this value is [0.022+0.008], which exceeds 0.02 wt. %.

The austenitic steel of the Example 2 may be cast using standard practices, and may be prepared in a forged or rolled condition. According to the invention, Example 2 may be heat-treated, for example, in a multi-step process. The first step may be a solutionizing treatment, in which the material is held for 3 hours at 1250° C., then quenched in room-temperature water. Next, the Example 2 material is sectioned off into 4 blanks, with each blank treated by one of the four treatments outlined below.

Accordingly, the first blank undergoes Heat Treatment 1 (HT1), and is held for 5 hours at 660° C., then quenched in room-temperature water. The second blank undergoes Heat Treatment 2 (HT2), and is held for 15 hours at 660° C., then quenched in room-temperature water. The third blank undergoes Heat Treatment 3 (HT3), and is held for 1.5 hours at 700° C., then quenched in room-temperature water. The fourth blank undergoes Heat Treatment 4 (HT4), and is held for 6 hours at 550° C., raised to 660° C. while still in the furnace, held for 15 hours at 660° C., then quenched in room-temperature water.

Figure 6:
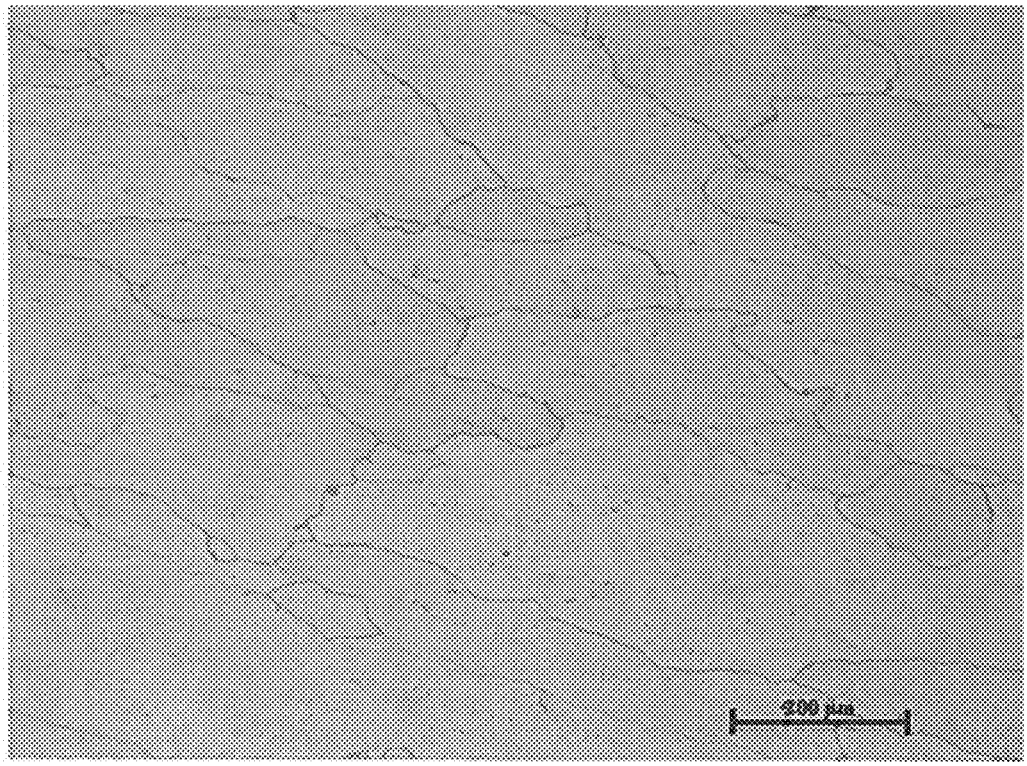
FIG. 6 is an exemplary micrographic illustration of the cast and heat-treated material of the Example 2, according to an embodiment of the invention.

FIG. 6 is an exemplary micrographic illustration of the cast and heat-treated material of the Example 2, according to an embodiment of the invention. In particular, FIG. 6 is an optical micrograph of the first blank of Example 2 that undergoes HT1, i.e., is held for 5 hours at 660° C., then quenched in room-temperature water. FIG. 2 shows a fully austenitic matrix with a coarse grain size typical of cast material, and the presence of some coarse carbides. Although not captured in this image, nanometer-scale carbides are expected to exist here as well.

Figure 7:
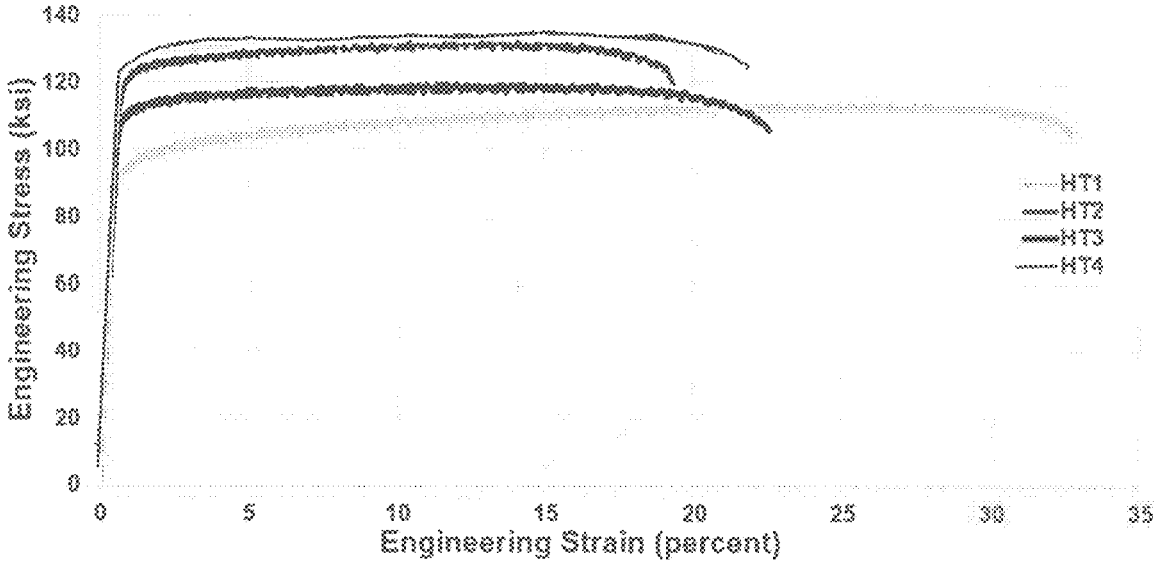
FIG. 7 is an exemplary graphical illustration, showing engineering stress and strain curves measured in different heat-treated conditions for the Example 2, according to embodiments of the invention.

FIG. 7 is an exemplary graphical illustration, showing engineering stress and strain curves measured in different heat-treated conditions for the Example 2, according to embodiments of the invention. FIG. 7 shows the tensile engineering stress-engineering strain curves for the four blanks of Example 2 as a result of the different heat treatments; HT1, HT2, HT3, and HT4. After the respective heat treatment process, the four blanks were machined into 0.252 inches-diameter tensile specimens and pulled to fracture, producing these stress-strain curves of FIG. 7.

Table 2 summarizes the mechanical properties exhibited graphically by the stress-strain curves of FIG. 7. Table 2 generally shows the tensile mechanical properties resulting from heat treatment. Table 2 includes columns showing for each particular sample as defined by the heat treatment (HT1, HT2, HT3, and HT4), the 0.2% offset yield stress, the tensile strength, the total elongation, and the uniform elongation. The measured yield strengths in all four heat-treated conditions exceed 80 ksi, while maintaining total elongations of at least 19%.

TABLE 2

Tensile Mechanical Properties Resulting From Heat Treatment

| Sample | 0.2% offset YS (ksi) | Ultimate tensile strength (ksi) | Total elongation (%) | Uniform elongation (%) |
|---|---|---|---|---|
| HT1 | 93.0 | 113.9 | 32.7 | 26.0 |
| HT2 | 118.6 | 132.9 | 19.3 | 13.5 |
| HT3 | 108.8 | 119.7 | 22.6 | 11.1 |
| HT4 | 124.4 | 135.1 | 22.0 | 16.3 |

Examples 3 and 4 of an austenitic steel composition, according to the invention are shown in Table 1. Examples 3 and 4 are defined by ranges of weight percentages. As shown in Table 1, the austenitic steel of Example 3 includes, 0.2-0.45 wt. % of carbon, 0.1-0.8 wt. % of silicon, 6-10 wt. % of manganese, 10-13.0 wt. % of nickel, wt. % of copper; 0.8-1.4 wt. % of vanadium, 0.5-2 wt. % of molybdenum, 0-3 wt. % of chromium; 0-0.05 wt. % of aluminum, 0-0.1 wt. % of calcium, 0-0.2 wt. % of titanium, 0-0.3 wt. % of niobium, 0-0.05 wt. % of tungsten, 0-0.2 wt. % of nitrogen, 0-0.1 wt. % of cerium; 0-0.1 wt. % of lanthanum, 0-0.04 wt. % of sulfur, and 0-0.04 wt. % of phosphorus. According to this preferred embodiment, the austenitic steel may also include 0-0.1 wt. % of cobalt.

As shown in Table 1, the austenitic steel of Example 4 includes, 0.25-0.4 wt. % of carbon, 0.2-0.6 wt. % of silicon, 6-9 wt. % of manganese, 10-13 wt. % of nickel, 1-2 wt. % of copper; 0.9-1.3 wt. % of vanadium, 0.6-1.5 wt. % of molybdenum, 0.3-2 wt. % of chromium; 0-0.05 wt. % of aluminum, 0-0.1 wt. % of calcium, 0-0.08 wt. % of titanium, 0.02-0.2 wt. % of niobium, 0-0.05 wt. % of tungsten, 0-0.15 wt. % of nitrogen, 0-wt. % of cerium; 0-0.1 wt. % of lanthanum, 0-0.03 wt. % of sulfur, and 0-0.03 wt. % of phosphorus. According to this preferred embodiment, the austenitic steel may also include 0-0.1 wt. % of cobalt.

Examples 3 and 4 may be prepared as outlined above, by for example, an initial homogenization heat treatment at 1050-1250° C., followed by a hot rolling or forging in the temperature range of 800-1250° C. Age-hardening heat treatment steps may also be applied to these materials. For example, a solution heat treatment at 1050-1250° C., followed by a water quench or air cool. Next, the austenitic steel material may undergo either a one-step age-hardening treatment, such as heating at 625-700° C. for 1-hours, followed by an air cool or water quench. A two-step age-hardening treatment may also be employed, such as heat treatment at 550-625° C. for 1-20 hours, followed by heat treatment at 630-700° C. for 1-20 hours, with both treatments concluded either by an air cool or water quench.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention. The invention including the stated variations is intended to be defined by the following claims and their equivalents, in which all terms are meant in their broadest reasonable sense unless otherwise indicated.

What is claimed is:

1. An austenitic steel composition comprising:

0.383 wt. % of carbon; 0.0721 wt. % of silicon; 6.92 wt. % of manganese; 13.0 wt. % of nickel; 1.91 wt. % of copper; 0.881 wt. % of vanadium; 0.94 wt. % of molybdenum; 0.104 wt. % of chromium; 0.0118 wt. % of aluminum; less than 0.005 wt. % of titanium; 0.0231 wt. % of niobium; 0.0124 wt. % of tungsten; 0.0097 wt. % of sulfur; less than 0.005 wt. % of phosphorus; 0-0.1 wt. % of calcium; 0-0.2 wt. % of nitrogen; 0-0.1 wt. % of cerium; 0-0.1 wt. % of lanthanum; and less than 0.001 wt. % of cobalt;

wherein the austenitic steel composition is precipitation strengthened and has a yield strength greater than 80 ksi, the austenitic steel composition includes a non-zero wt. % amount of at least one of the calcium, the cerium, and the lanthanum, and a product of [carbon+nitrogen][vanadium], expressed in weight percent, is at least 0.33.

2. An austenitic steel composition comprising:

0.32 wt. % of carbon; 0.80 wt. % of silicon; 6.24 wt. % of manganese; 11.4 wt. % of nickel; 1.51 wt. % of copper; 1.16 wt. % of vanadium; 0.60 wt. % of molybdenum; 1.98 wt. % of chromium; 0.017 wt. % of aluminum; 0.022 wt. % of titanium; 0.008 wt. % of niobium; 0.033 wt. % of tungsten; 0.020 wt. % cobalt; 0.005 wt. % of sulfur; 0-0.1 wt. % of calcium; 0-0.2 wt. % of nitrogen; 0-0.1 wt. % of cerium; 0-0.1 wt. % of lanthanum; and 0.009 wt. % of phosphorus, wherein the austenitic steel composition is precipitation strengthened and has a yield strength greater than 80 ksi, the austenitic steel composition includes a non-zero wt. % amount of at least one of the calcium, the cerium, and the lanthanum, and a product of [carbon+nitrogen] [vanadium], expressed in weight percent, is at least 0.33.

* * * * *